United States Patent [19]

Sauber et al.

[11] Patent Number: 4,800,734

[45] Date of Patent: Jan. 31, 1989

[54] ROOM AIR CONDITIONER

[75] Inventors: R. Stuart Sauber, Lowell; Paul J. Horvath, Belding, both of Mich.

[73] Assignee: White Consolidated Industries, Inc., Cleveland, Ohio

[21] Appl. No.: 115,114

[22] Filed: Nov. 2, 1987

[51] Int. Cl.[4] ..... F25D 23/12

[52] U.S. Cl. ..... 62/263; 62/429; 29/453; 220/4 B; 312/236; 312/264

[58] Field of Search ..... 62/262, 263, 428, 429; 312/236, 264; 220/4 B, 4 R; 29/453, 463

[56] References Cited

U.S. PATENT DOCUMENTS

| | | | |
|---|---|---|---|
| 2,335,627 | 11/1943 | WOlfert | 62/262 |
| 2,675,937 | 4/1954 | Philipp | 220/4 R |
| 2,939,297 | 6/1960 | Karger et al. | 62/429 X |
| 2,945,359 | 7/1960 | MacCleod | 62/429 X |
| 2,959,037 | 11/1960 | Mehalick et al. | 62/429 |
| 3,756,039 | 9/1973 | Riello | 62/262 |
| 3,766,749 | 10/1973 | Livesay | 62/262 |
| 3,802,946 | 4/1974 | Chase | 29/453 X |
| 3,819,244 | 6/1974 | Paulick et al. | 312/101 |
| 3,887,977 | 6/1975 | Riello | 29/463 X |
| 3,906,741 | 9/1975 | Terry | 62/262 |
| 4,100,764 | 7/1978 | Murano | 62/262 X |
| 4,607,499 | 8/1986 | Bolton et al. | 62/262 |
| 4,641,502 | 2/1987 | Aldrich et al. | 62/429 X |
| 4,712,657 | 12/1987 | Myers et al. | 220/4 B X |

*Primary Examiner*—William E. Tapolcai

*Attorney, Agent, or Firm*—Pearne, Gordon, McCoy & Granger

[57] ABSTRACT

A room air conditioner unit is disclosed having a molded polymeric chassis consisting primarily of two chassis members. A sheet metal wrapper is removably installed with four corner fasteners and gives an external appearance of a metal unit, as well as assisting in holding the two chassis members together. All of the operative components of the unit are positioned and supported on the lower chassis member and can be operationally tested prior to installation of the upper chassis member or the sheet metal wrapper. The two chassis members are interconnected without separate fasteners and the only operational component requiring separate fasteners is the compressor itself. The unit is therefore well adapted for automated manufacture with a minimum of labor content during either manufacture or repair.

5 Claims, 5 Drawing Sheets

ROOM AIR CONDITIONER

BACKGROUND OF THE INVENTION

This invention relates generally to air conditioning structures, and more particularly to a novel and improved molded plastic chassis structure particularly suited for room air conditioners.

PRIOR ART

Generally in the past, room air conditioners have been provided with metallic chassis which include a large number of parts that are assembled and connected by fasteners. Because a multiplicity of parts and fasteners are required in such units, relatively high material and labor costs are involved during manufacture. Further, such units are often difficult to service and repair.

More recently, some room air conditioning units are fabricated from an assembly including molded plastic parts formed to reduce the number of component parts and to reduce labor of assembly and servicing. However, in most cases, a metal base has been retained and, in some cases, the outer cabinet or wrapper is provided by plastic. Examples of such units are illustrated in U.S. Pat. Nos. 2,959,037; 3,756,039; 3,819,244; and 3,906,741.

In most cases, the chassis of such units still require a relatively large number of parts which must be assembled during manufacture using a substantia number of fasteners and which must be disassembled when rapair and service are required. Further, when the exterior surfaces are plastic, the units have not been well accepted by customers.

SUMMARY OF THE INVENTION

The present invention provides a novel and improved air conditioner structure particularly suited for room air conditioning units. In accordance with the present invention, a molded polymeric chassis is formed of two major components which cooperate to support and position all of the operative components of the unit. These two major components are a lower or base member and an upper member. The chassis is enclosed within a one-piece sheet metal wrapper which provides the upper external surface and the two external side surfaces of the unit. The lower exposed surface is provided by the base chassis member. The wrapper is removably installed with only four screws so that it is easily installed during manufacture and is easily removed when service or repair is required. When the wrapper is removed, substantial access to the operative components of the unit is provided. However, if greater access is required, the upper chassis member can be easily removed.

Within the unit, the two chassis members provide wall portions which cooperate to separate the evaporator compartment from the condenser compartment. Further, the unitary lower or base member provides the support for all of the operative components. Therefore, all of the operative components of the unit can be assembled on the base member and fully tested while maximum access is provided. This facilitates automated manufacturing processes.

After the assembled components are installed and tested, the upper chassis member is installed as a unit. In the preferred embodiment, the upper chassis member is secured to the lower chassis member by integral latching structures without separate fasteners. This greatly facilitates the automated manufacture of the unit.

Thereafter, the sheet metal wrapped is installed and the front grille is installed to complete the assembly of the entire unit.

With this invention, all of the operative components are supported on a molded plastic chassis, and are spaced from the sheet metal wrapper. Therefore, a quiet operating unit is provided. However, the wrapper provides an exterior metallic appearance which is more acceptable to many consumers.

The sheet metal wrapper cooperates with the chassis members to define the condenser chamber and the evaporator chamber, and in the illustrated embodiment provides a substantial portion of the wall surface of each chamber. Two benefits are derived from such a combination. First, since the wrapper provides a substantial portion of the wall surface of the chambers, the size and the complexity of the chassis members can be minimized. Second, when the wrapper is removed, virtually complete access is provided to the majority of the components and areas of the unit.

Still further, the chassis members are structured so that it is not necessary to use separate fasteners to mount either of the heat exchangers or the motor fan assembly. In fact, with the illustrated embodiment, the only operating component of the unit requiring separate fasteners for mounting purposes is the compressor itself.

These and other aspects of this invention are illustrated in the accompanying drawings, and are more fully described in the following specification.

DETAILED DESCRIPTION OF THE DRAWINGS

Figure 1:
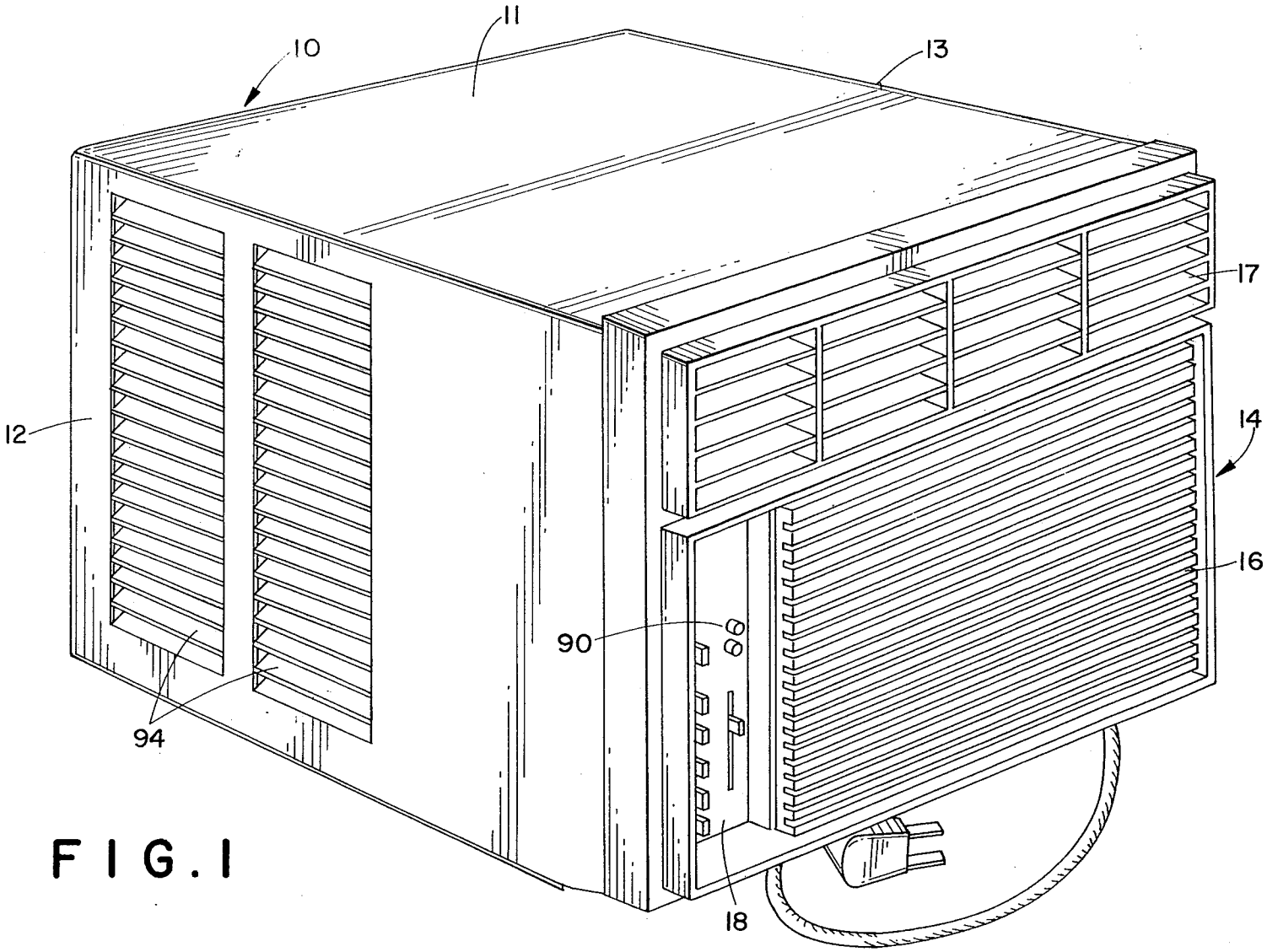
FIG. 1 is a perspective view of a preferred embodiment of a room air conditioner incorporating the present invention.

FIG. 1 illustrates the overall exterior appearance of a preferred embodiment of a room air conditioner incorporating the present invention. The illustrated unit includes a one-piece sheet metal wrapper 10 providing the upper exterior surface 11 and the two exterior side surfaces 12 and 13 of the unit. The wrapper 10 is formed to provide a flange along the lower edge of each side exterior surface 12 and 13 which extends under the unit and is secured by corner fasteners, as discussed below.

The forward or front face of the unit is provided by a molded polymeric grille 14. The grille provides an inlet grille portion 16 through which air is drawn over an evaporator heat exchanger by an internal fan, as discussed below. Such air is cooled as it passes over the evaporator heat exchanger and is exhausted from the unit through an exhaust grille portion 17. The front grille 14 also provides a control panel portion 18 for the control of the unit. Grilles of this type have been commonly used on room air conditioner units and, except to the extent recited in the claims, form no part of this invention.

Figure 2:
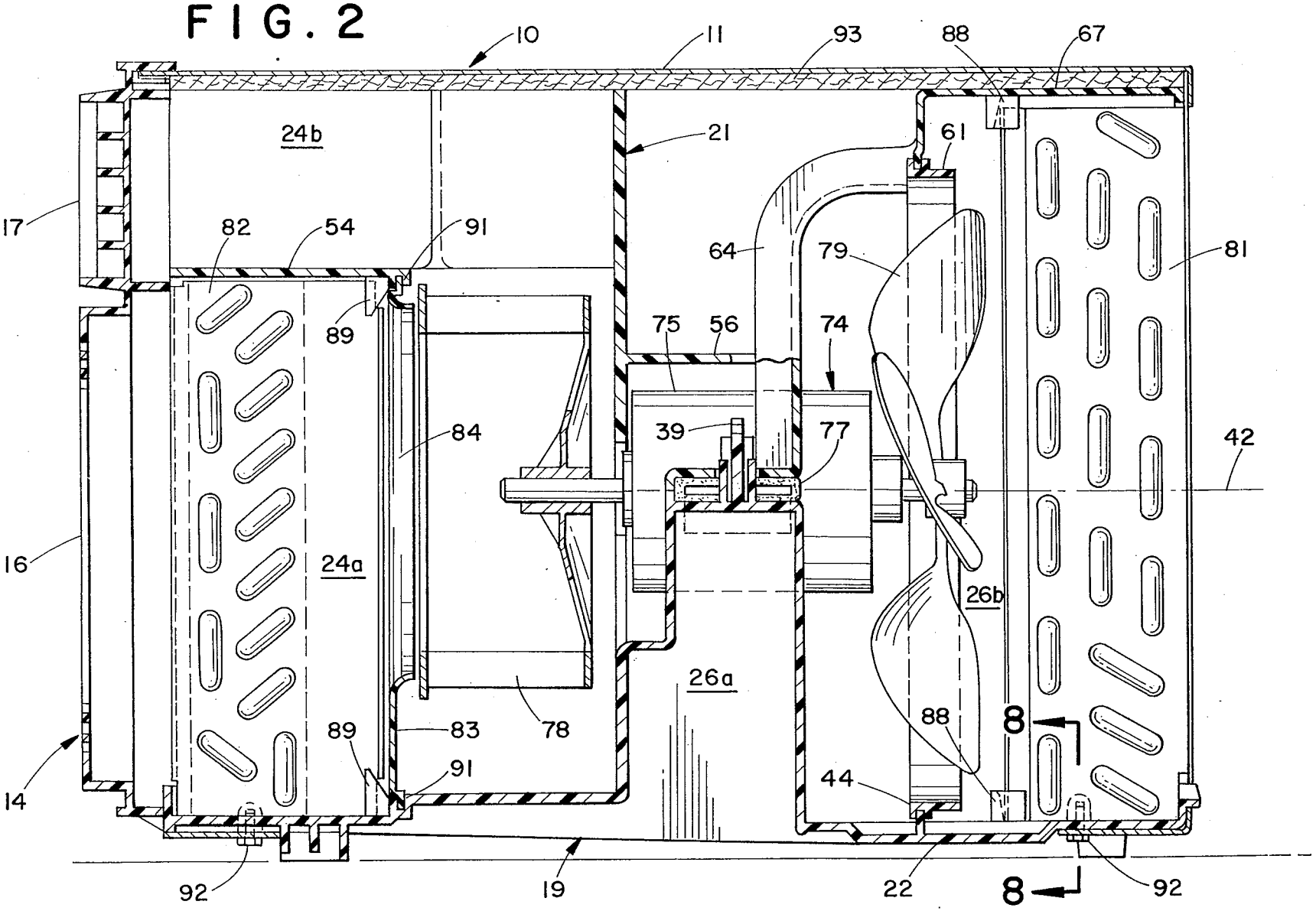
FIG. 2 is a side elevation taken along a broken section line selected to illustrate the structure for mounting the heat exchangers and the motor fan assembly.
Figure 3:
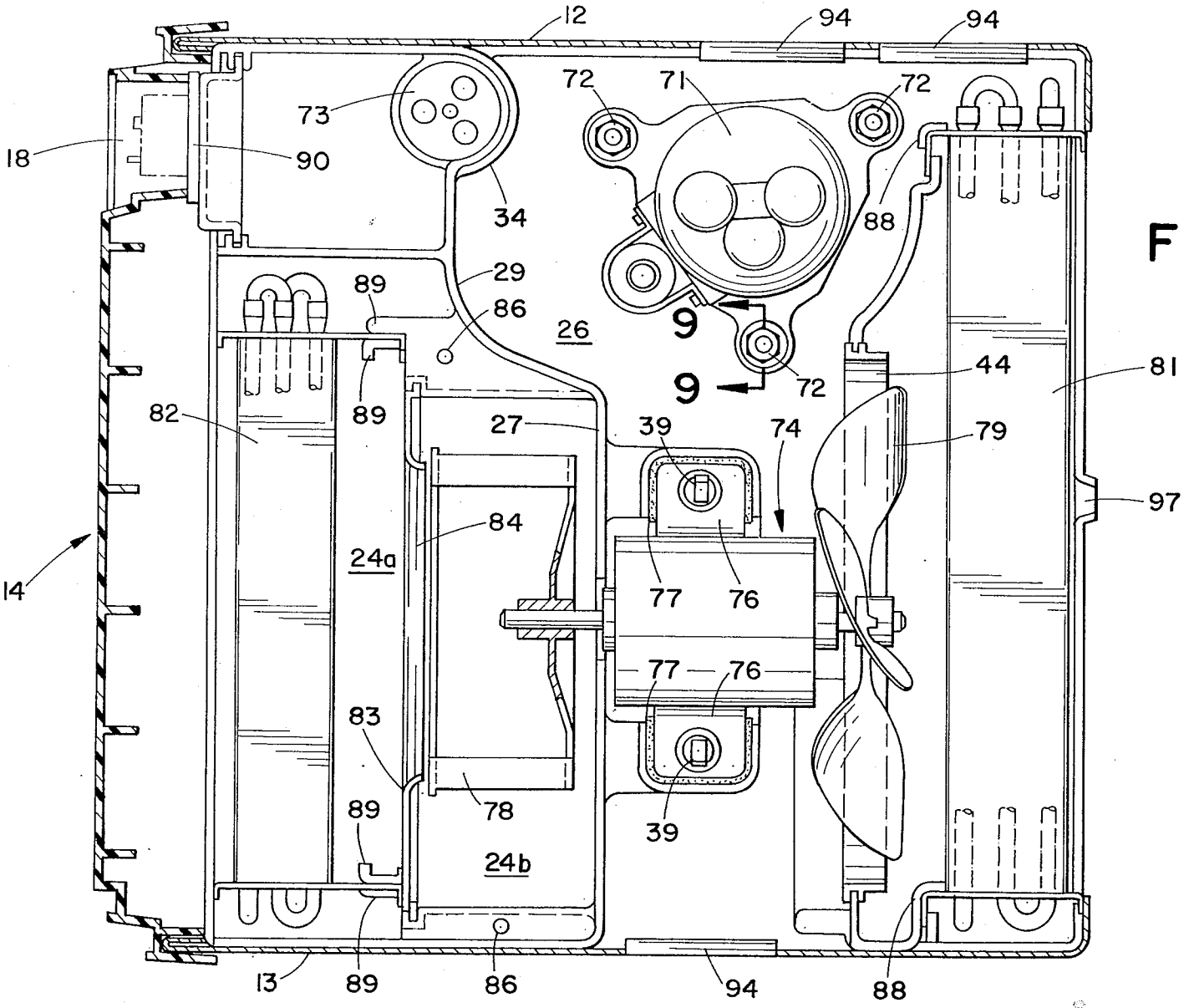
FIG. 3 is a plan view of the unit, with the upper chassis member and wrapper removed.
Figures 4, 5:
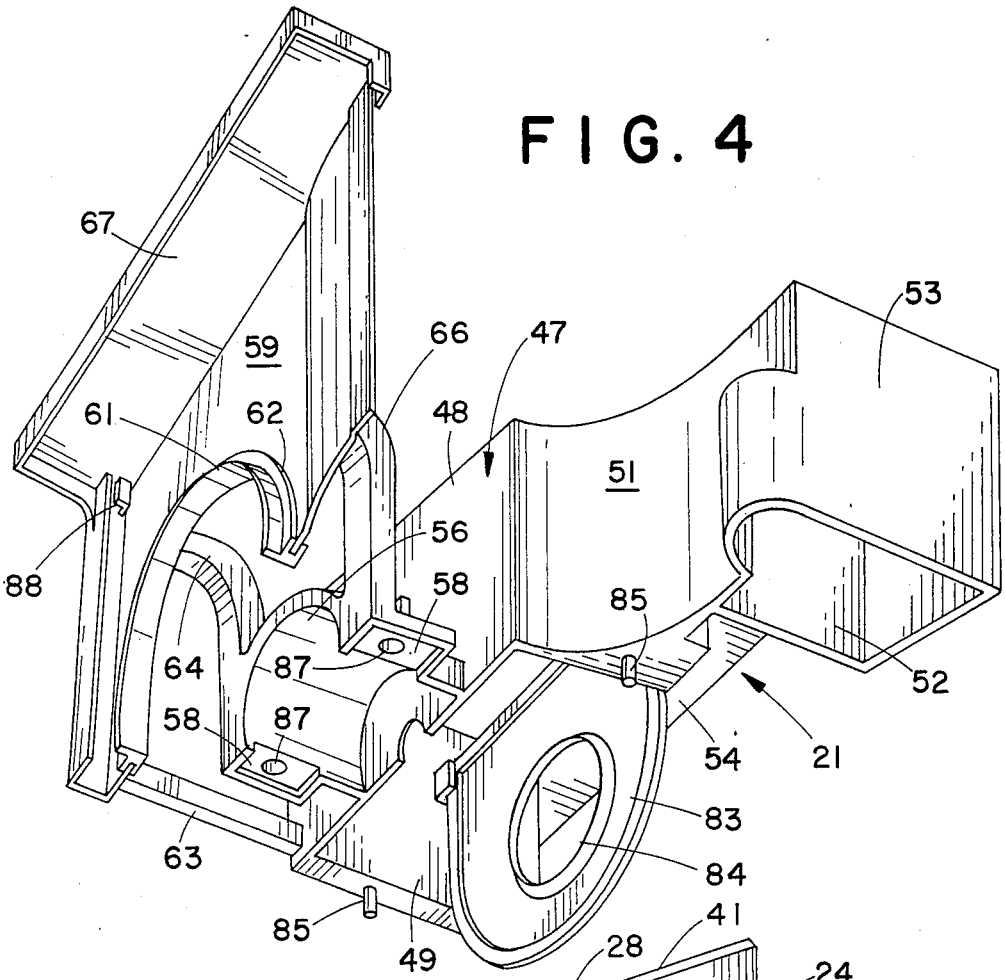
FIG. 4 is a perspective view of the upper chassis member, illustrating the structural detail thereof.
FIG. 5 is a perspective view of the lower chassis member, illustrating the structural detail thereof.

Reference should now be made to FIGS. 2 through 6, which illustrate the structural detail of the interior components of the unit. The unit is provided with a polymeric molded chassis consisting of a lower or base chassis member 19 and an upper chassis member 21. As best illustrated in FIG. 5, the lower chassis member 19 provides a base wall 22. Extending upwardly from the base wall are two separate walls. The first upstanding wall 23 cooperates with a mating wall (described in detail below) to divide the interior of the unit into an evaporator chamber 24 and a condenser chamber 26.

The upstanding wall 23 includes a forward planar portion 27 extending laterally from a first side wall portion 28 along one side of the base wall 22 to a curved wall portion 29. Extending longitudinally of the base 22 are a pair of opposed wall portions 31 and 32 which cooperate to define a control chamber 33. The curved wall portion 29 is also provided with a reverse bend 34 for an electrical condenser as described below.

Extending rearwardly from the planar wall portion 27 are a pair of upstanding motor mounts 36 and 37, each providing a pocket 38 at its upper end. Each of the motor mounts 36 and 37 also includes a latching projection 39 which serves to interconnect the lower chassis member 19 on the upper chassis member 21 when they are assembled.

The upstanding wall 23 extends upwardly from the base to an upper edge 41 which extends along a central horizontal plane 42 (illustrated in FIG. 2) substantially midway between the upper and lower surfaces of the unit.

The lower chassis member 19 also provides a second upstanding wall 43 which functions as the support for a semicylindrical shroud member 44. The shroud member 44 is also a molded polymeric material and is formed with an external channel structure 46 which embraces the mating edge of the second upstanding wall. A permanent assembly may be provided therebetween by using an adhesive along the channel.

The second upstanding wall 43 and shroud member 44 cooperate with mating wall portions in the upper chassis member (described below) to divide the condenser chamber into an inlet zone **26*a* and a discharge zone 26*b***.

The upper chassis member 21 has a structure best illustrated in FIG. 4. It includes a forward wall 47 which cooperates with the upstanding wall 23 to complete the separation of the two chambers 24 and 26. This wall includes a planar wall portion 48 mating with the wall portion 27 of the lower chassis member, a side wall portion 49 mating with the side wall portion 28, and a curved wall portion 51 mating with the curved wall portion 29. A pair of opposed wall portions 52 and 53 are sized to mate with the opposed wall portions 31 and 32 of the lower chassis member 19 and cooperate therewith to define the control panel chamber.

The upper chassis member also provides a horizontally extending wall 54 which horizontally divides the evaporator chamber 24, as discussed below.

Extending rearwardly from the planar wall portion 48 is a semicylindrical motor mounting portion 56 providing pockets 58 which mate with the pockets 38 to support the fan motor, as discussed below.

The rearward part of the upper chassis member includes a second vertically extending wall portion 59 which mates with the second upstanding wall 43. Here again, a separate semicylindrical shroud member 61 providing external channels 62 is mounted on the rearward wall portion 59. Adhesives can be used to permanently connect the shroud member 61 and the upper chassis member.

Figure 6:
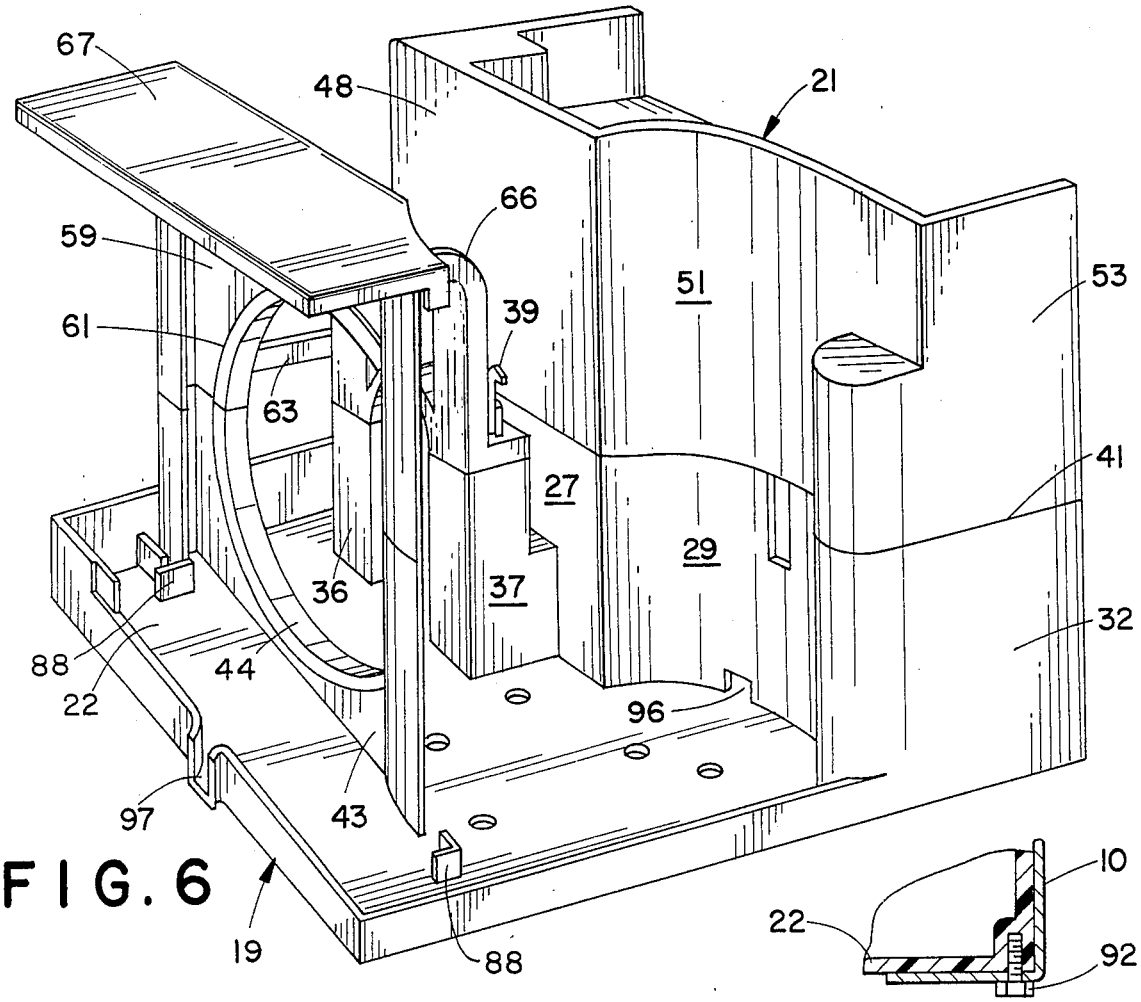
FIG. 6 is a perspective view of the assembled chassis members without the operative components of the unit installed.
Figure 8:
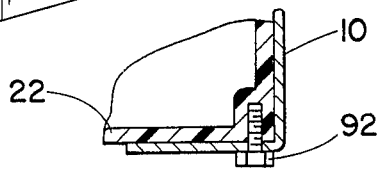
FIG. 8 is an enlarged, fragmentary section illustrating the structure for mounting the sheet metal wrapper on the lower or base chassis member.

When the two chassis members are assembled, as illustrated in FIG. 6, the two shroud members 44 and 61 cooperate to provide a cylindrical opening in which the condenser fan is positioned, as discussed below. The rearward wall portion 59 is connected to the planar wall portion 48 of the forward wall 47 by three spaced beams 63, 64, and 66. These beams provide support between the two sections of the upper chassis member while not interfering appreciably with air flow through the condenser chamber 26. A horizontally extending cap portion 67 extends rearwardly from the upper edge of the rearward wall portion 59 to provide a cover section along the top of the condenser heat exchanger.

Figure 9:
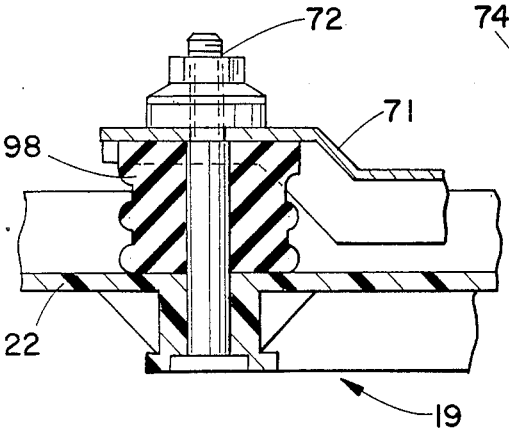
FIG. 9 is an enlarged, fragmentary section illustrating the mounting structure for the compressor.

Referring now to FIGS. 2 and 3, the operative components of the unit are first assembled on the lower chassis member 19. A compressor 71 is mounted with bolts 72 on the base wall 22 of the lower chassis member 19. Preferably, rubber grommets 98 (illustrated in FIG. 9) cushion the compressor and resist vibration transmission.

An electric power condenser 73 for the compressor 71 is mounted within the reverse bend wall portion 34. A motor and fan assembly 74 provides lateral mounting projections 76 within a rubber cushioning grommet 77 positioned within the pockets 38 and 58. The motor provides a fan on each end of the motor shaft. A squirrel cage fan 78 is mounted on the forward end of the motor shaft within the evaporator chamber and an axial blade fan 79 is mounted on the rearward end of the motor shaft within the shroud provided by the two shroud members 44 and 61.

A condenser heat exchanger 81 is mounted at the rearward end of the chassis assembly, and an evaporator heat exchanger 82 is mounted at the forward end of the chassis assembly. Positioned immediately in front of the squirrel cage fan 78 is a separate shroud member 83 which is preferably molded from a polymeric material and provides an opening 84 aligned with the squirrel cage fan through which air is drawn by the fan over the evaporator 82, as discussed below. Here again, the shroud member 82 divides the associated evaporator chamber 24 into an inlet zone **24*a* and a discharge zone 24*b***.

A control panel 90 is mounted within channels provided in the opposed side walls 31 and 32 within the control chamber 33. Because all of the operative components can be assembled on the lower chassis member, the preferred embodiment lends itself to automated assembly and also permits the unit to be assembled and tested for proper operation before installing the upper chassis member 21. The wiring harness has not been illustrated in order to simplify the understanding of this invention, but a conventional harness is utilized to connect the various electrical components of the system.

Figure 7:
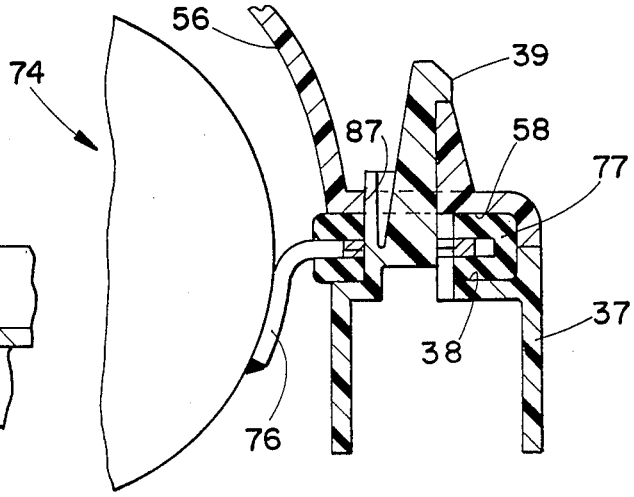
FIG. 7 is an enlarged, fragmentary section illustrating the structure for mounting the motor fan assembly and for latching the two chassis members together.

After all of the operative components are installed and tested, the assembly of the unit is completed by merely installing the upper chassis member on the lower chassis member. During such assembly, the latching projections 39 are positioned up along the openings 87 in the pockets 58 and fasten the two chassis members together, as best illustrated in FIG. 7. Preferably, locating projections 85 are provided on the upper chassis member which fit into mating locating bores 86 during assembly to ensure accurate alignment of the two chassis members. Further, the two chassis members are provided with locating grooves and projections 88 and 89 (illustrated in FIGS. 2 and 3) which interfit with the end plates of the two heat exchangers 81 and 82, respectively, to secure each of the heat exchangers in its mounted position.

The two chassis members do not require any separate fasteners to connect them together, and the latching projections 39, in cooperation with the locating projections 85, provide the sole interconnection between the two chassis members. However, the shroud 83 extends along channels 91 formed in the lower chassis member, and does provides a spline-type interconnection between the two chassis members to assist in maintaining them in their proper assembled position.

In the event that service or repair require disassembly of the unit, the latching members 39 are released and the upper chassis member is lifted off the unit to provide full access to all of the operative components of the system so that they may be easily repaired or replaced if necessary.

After the upper and lower chassis members are assembled, the sheet metal wrapper 10 is installed by merely spreading the side walls thereof slightly and moving it down to the installed position. In the installed position, flanges on the wrapper extend under the base wall 22 and the wrapper is secured to the lower chassis member by four screws 92, with one installed in each corner of the unit.

Positioned between the upper wall 11 of the wrapper 10 and the adjacent parts of the upper chassis 21 is a felt pad 93. This pad has several functions. It provides a gasket-like structure to prevent leakage between the condenser chamber and the evaporator chamber, it provides sound-deadening, and it also provides thermal insulation between the wrapper and the evaporator unit. After the wrapper is installed, the grille 14 is merely snapped into place to complete the assembly of the unit. The wrapper also functions to clamp the two chassis members together.

In operation, air is drawn in through the inlet grille portion 16 and over the evaporator heat exchanger 82 by the squirrel cage fan 78. The air is exhausted from the periphery of the fan and is carried up along the rearward side of the shroud 83 and is exhausted through the exhaust portion 17 of the grille into the room being air conditioned.

At the same time, air is drawn into the unit through side louvers 94 in the two exterior side walls of the upper 10 by the fan 79. This air serves to cool the compressor and then is exhausted by the fan through the condenser heat exchanger 81 and it passes out of the rearward end of the unit. Because the motor 75 of the motor fan assembly is spaced from the adjacent portions of the chassis members 19 and 21, the air passing through the condenser chamber also provides cooling of the fan motor 75.

Condensate collected on the evaporator flows through an opening 96 in the upstanding wall and along the base wall 22 toward the rear of the unit. In most cases, this condensate is evaporated by the air passing through the condenser chamber; however, in extremely damp weather, such condensate may be carried along the wall to a discharge opening at 97 at the rear of the unit. Preferably, the base wall 22 is inclined at a shallow angle so that condensate will flow from the forward end of the unit to the rearward end of the unit and does not collect and overflow within the room being conditioned by the unit.

It is preferable to provide the side wall portions 28, 32, 49, and 53 on the chassis to isolate the side walls 12 and 13 of the wrapper from the evaporator compartment so as to reduce the tendency for condensate to collect on the wrapper at the forward end of the unit. In effect, the wrapper is thermally isolated from the entire evaporator compartment by these wall portions and the felt pad 93.

With the present invention, a minimum number of parts are required to mount the various operative components within the unit. The chassis itself provides two basis chassis members, namely, the lower chassis member 19 and the upper chassis member 21. Only three additional chassis parts are required, namely, the shrouds 44, 61, and 83, and these are easily assembled on their respective chassis members. The only threaded fasteners required in the entire unit are the three bolts 72 required to mount the compressor and the four screws 92 which removably secure the wrapper on the unit. Because all of the exterior surfaces of the unit other than the bottom surface and the grille are formed of metal, the appearance of the unit is that of a conventional metal assembly; therefore, customer resistance often encountered with plastic exposed parts is eliminated.

Although the preferred embodiment of this invention has been shown and described, it should be understood that various modifications and rearrangements of the parts may be resorted to without departing from the scope of the invention as disclosed and claimed herein.

What is claimed is:

1. A room air conditioner comprising upper and lower unitary non-metallic molded chassis members cooperating to provide a base wall and vertically extending walls, a wrapper cooperating with said chassis members to define an interior space of said air conditioner, said vertically extending walls dividing said interior space into a condenser chamber and evaporator chamber, said air conditioner providing a plurality of operating components mounted on said lower chassis member, one of said components being a compressor, the remainder of said components being secured in position without separate fasteners, wherein said wrapper encloses the top and side walls of said chassis members and assists in holding said chassis members in an assembled position, and said wrapper provides flanges extending under the edges of said base wall, and fasteners releasably connect said flanges to said base wall.

2. A room air conditioning unit comprising a chassis molded of polymeric material, including a unitary lower chassis member, a unitary upper chassis member, and a sheet metal wrapper providing a top wall and opposed side walls, said chassis and wrapper cooperating to define an interior space of said unit in which the lower side is defined by said lower chassis member, said lower chassis member providing an upwardly extending wall extending substantially one-half the height of the interior space between said side walls of said wrapper, said upper chassis member providing a depending wall extending downwardly to said upwardly extending wall, and cooperating therewith to divide said interior space into a condenser chamber and an evaporator chamber, a compressor in said condenser chamber supported by said lower chassis member, a condenser heat exchanger in said condenser chamber supported by said lower chassis member, an evaporator heat exchanger in said evaporator chamber supported by said lower chassis member, a fan motor assembly supported in said lower chassis member, said fan motor assembly providing a fan in each of said chambers for moving air over the associated heat exchanger, said upper chassis member cooperating with said lower chassis member to locate said heat exchangers and said fan motor assembly without separate fasteners, and separate fastener means securing said wrapper side wall to said lower chassis member so that said wrapper serves to clamp said upper and lower chassis members together as a unit.

3. A room air conditioner as set forth in claim 2, wherein said chassis members divide each chamber into an inlet zone and an exhaust zone and said fans each operate to draw air into the associated inlet zone and to exhaust air through the associated outlet zone.

4. A room air conditioning unit comprising a chassis molded of polymeric material, said chassis including a unitary lower chassis member and a unitary upper chassis member, a sheet metal wrapper providing a top wall and opposed side walls, said lower chassis member providing an upwardly extending wall extending substantially one-half the height of the interior space between said side walls of said wrapper, said upper chassis member providing a depending wall extending downwardly to said upwardly extending wall, a compressor secured to said lower chassis member, a condenser heat exchanger supported by said lower chassis member, an evaporator heat exchanger supported by said lower chassis member, interengaging motor mount means on said lower and upper chassis members, a fan motor assembly supported by said motor mount means, said fan motor assembly providing separate fans for moving air over the associated heat exchangers, said upper chassis member cooperating with said lower chassis member to locate said heat exchangers, said motor mounted means including latching means securing together said lower and upper chassis members, and fastener means securing said wrapper side walls to said lower chassis member.

5. A room air conditioning unit as set forth in claim 4, wherein said latching means are integral with said chassis members.

* * * * *